US007498474B2

(12) United States Patent
Umansky et al.

(10) Patent No.: US 7,498,474 B2
(45) **Date of Patent: *Mar. 3, 2009**

(54) VAPOR PHASE AROMATICS ALKYLATION PROCESS

(75) Inventors: Benjamin S. Umansky, Fairfax, VA (US); Michael C. Clark, Pasandena, TX (US); Ajit B. Dandekar, New York, NY (US); Christine N. Elia, Bridgewater, NJ (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 156 days.

This patent is subject to a terminal disclaimer.

(21) Appl. No.: 11/362,255

(22) Filed: Feb. 27, 2006

(65) Prior Publication Data

US 2006/0194997 A1 Aug. 31, 2006

Related U.S. Application Data

(60) Provisional application No. 60/656,945, filed on Feb. 28, 2005, provisional application No. 60/656,954, filed on Feb. 28, 2005, provisional application No. 60/656,955, filed on Feb. 28, 2005, provisional application No. 60/656,946, filed on Feb. 28, 2005, provisional application No. 60/656,947, filed on Feb. 28, 2005.

(51) Int. Cl.
*C07C 2/66* (2006.01)

(52) U.S. Cl. ..... 585/449; 585/467

(58) Field of Classification Search ..... 585/467, 585/449

See application file for complete search history.

(56) References Cited

U.S. PATENT DOCUMENTS 3,751,504 A 8/1973 Keown ..... 260/672
4,016,218 A 4/1977 Haag ..... 260/671

(Continued)

FOREIGN PATENT DOCUMENTS

CN 1464035 12/2003

(Continued)

OTHER PUBLICATIONS

R. J. Hengstebeck, "Petroleum Processing Principles and Applications", (1959), pp. 212-218, New York, McGraw-Hill Book Company, Lib. Cong. Cat. No. 58-13006.

(Continued)

*Primary Examiner*—Thuan Dinh Dang
(74) *Attorney, Agent, or Firm*—Gerald L. Harris

(57) ABSTRACT

A process for the production of high octane number gasoline from light refinery olefins and benzene-containing aromatic streams such as reformate. The process achieves good utilization of both the ethylene and the propylene present in the mixed olefin feed from the unsaturated gas plant while reducing gasoline benzene levels. The light olefins including ethylene and propylene are reacted with the light aromatic stream containing benzene and other single ring aromatic compounds to form a gasoline boiling range product containing akylaromatics. The reaction is carried out with a two-catalyst system which comprises a member of the MWW family of zeolites and an intermediate pore size zeolite such as ZSM-5 using a fixed catalyst bed in both stages. Use of the two catalyst system enables the conversion of the ethylene and propylene components of the olefin feed to be converted to alkylaromatics under favorable conditions.

7 Claims, 1 Drawing Sheet

U.S. PATENT DOCUMENTS

Figure 1:
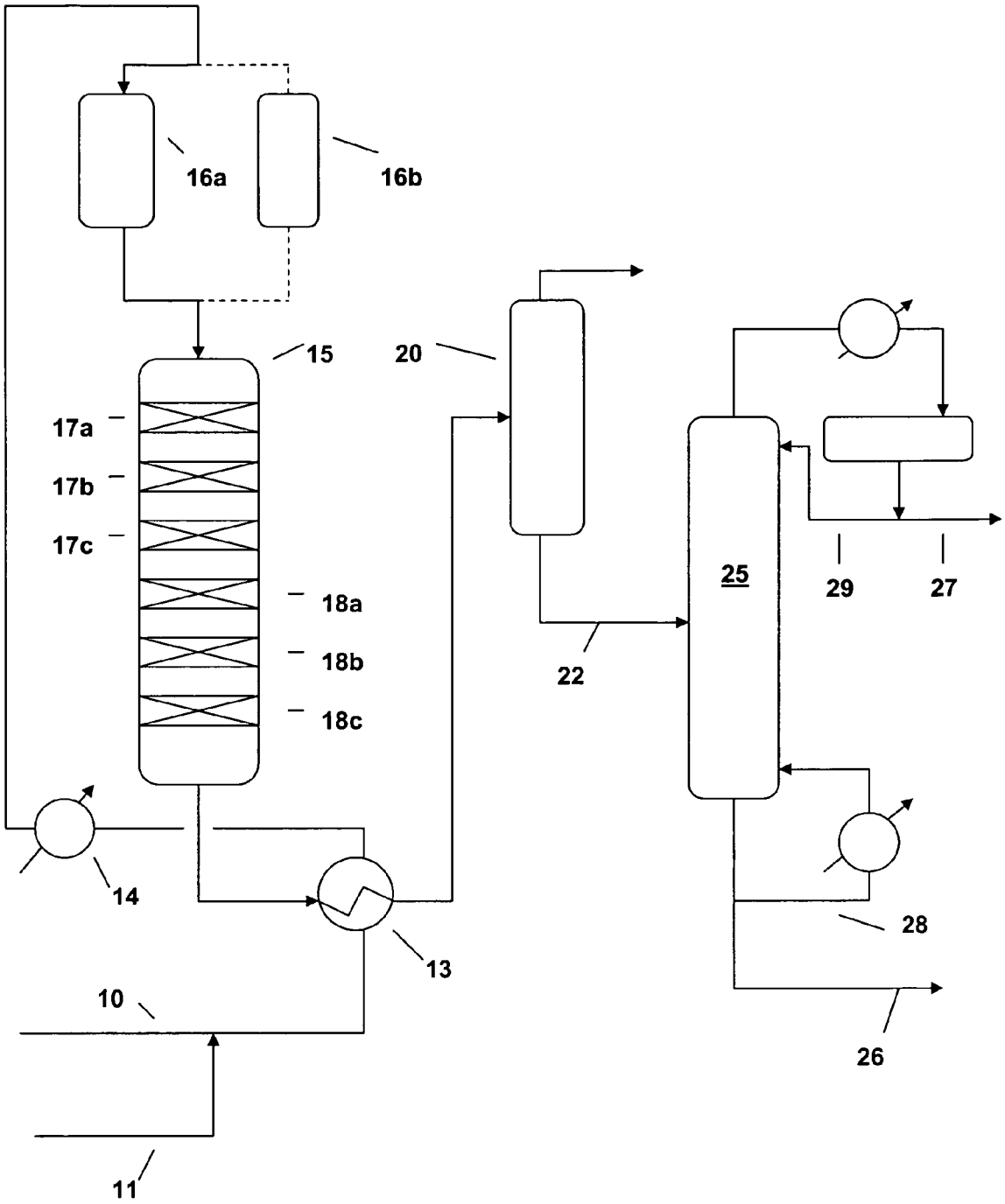

| | | | | | |
|---|---|---|---|---|---|
| 4,169,111 | A | | 9/1979 | Wight | 585/323 |
| 4,459,426 | A | | 7/1984 | Inwood | 585/323 |
| 4,547,605 | A | | 10/1985 | Kresge | 585/467 |
| 4,891,458 | A | | 1/1990 | Innes | 585/323 |
| 4,954,325 | A | | 9/1990 | Rubin | 423/328 |
| 4,956,514 | A | | 9/1990 | Chu | 585/533 |
| 4,992,606 | A | | 2/1991 | Kushnerick | 585/467 |
| 5,077,445 | A | | 12/1991 | Le | 585/467 |
| 5,175,185 | A | | 12/1992 | Chandraratna | 514/445 |
| 5,236,575 | A | | 8/1993 | Bennett | 208/46 |
| 5,334,795 | A | | 8/1994 | Chu | 585/467 |
| 5,336,820 | A | * | 8/1994 | Owen et al. | 585/323 |
| 5,371,310 | A | | 12/1994 | Bennett | 585/467 |
| 5,493,065 | A | | 2/1996 | Cheng | 585/467 |
| 5,877,370 | A | | 3/1999 | Gajda | |
| 5,900,520 | A | | 5/1999 | Mazzone | 585/467 |
| 5,902,917 | A | | 5/1999 | Collins | 585/323 |
| 5,907,073 | A | | 5/1999 | Ghosh | 585/467 |
| 6,025,534 | A | | 2/2000 | Valente | |
| 6,043,402 | A | | 3/2000 | Gajda | |
| 6,051,521 | A | | 4/2000 | Cheng | 502/86 |
| 6,060,632 | A | | 5/2000 | Takamatsu | 585/467 |
| 6,479,721 | B1 | | 11/2002 | Gajda et al. | |
| 6,703,356 | B1 | | 3/2004 | Wu | 508/591 |
| 6,855,855 | B2 | | 2/2005 | Van Den Brink et al. | |
| 6,872,864 | B2 | | 3/2005 | Gajda et al. | |

FOREIGN PATENT DOCUMENTS

| | | | |
|---|---|---|---|
| WO | WO 01/83408 | A1 | 11/2001 |
| WO | WO 01/96013 | A1 | 12/2001 |
| WO | WO 03/076074 | A1 | 9/2003 |
| WO | WO 2004/085062 | A1 | 10/2004 |

OTHER PUBLICATIONS

UOP LLC, "UOP Catalytic Condensation Process for Higher Olefins", (2004).
UOP LLC, "SPA-1™ and SPA-2™ Catalysts", (2004).
International Search Report, PCT/US2007/017172, mailed Feb. 22, 2008.
Written Opinion, PCT Application No. PCT/US2007/017172, mailed Feb. 22, 2008.
Vita Maselli, "Written Opinion", Jul. 29, 2008, pp. 5-9, Australia.

* cited by examiner

VAPOR PHASE AROMATICS ALKYLATION PROCESS

CROSS REFERENCE TO RELATED APPLICATIONS

This application claims priority from U.S. application Ser. No. 60/656,945, filed 28 Feb. 2005, entitled "Vapor Phase Aromatics Alkylation Process".

This application is related to co-pending applications Ser. Nos. 11/362,257; 11/362,256; 11/362,139 and 11/362,128of even date, claiming priority, respectively from applications Ser. Nos. 60/656,954, 60/656,955, 60/656,946 and 60/656,947, all filed 28 Feb., 2005 and entitled respectively, "Gasoline Production By Olefin Polymerization", "Process for Making High Octane Gasoline with Reduced Benzene Content", "Liquid Phase Aromatics Alkylation Process" and "Olefins Upgrading Process", now published as U.S. Pat. Publication Nos. 2006/0194999; 2006/0194998; U.S. 2006-0194996 A1 and 2006/019495.

Reference is made to the above applications for further details of the process described below, as they are referred to in this application.

FIELD OF THE INVENTION

This invention relates to a process for the production of a high octane, aromatic gasoline boiling range motor fuel by the reaction of light olefins with aromatic hydrocarbons in the vapor phase.

BACKGROUND OF THE INVENTION

In recent years, environmental laws and regulations the have limited the amount of benzene which is permissible in petroleum motor fuels. These regulations have produced substantial changes in refinery operation. To comply with these regulations, some refineries have excluded $C_6$ compounds from reformer feed so as to avoid the production of benzene directly. An alternative approach is to remove the benzene from the reformate after it is formed by means of an aromatics extraction process such as the Sullfolane Process or UDEX Process. Well-integrated refineries with aromatics extraction units associated with petrochemical plants usually have the ability to accommodate the benzene limitations by diverting extracted benzene to petrochemicals uses but it is more difficult to meet the benzene specification for refineries without the petrochemical capability. While sale of the extracted benzene as product to petrochemicals purchasers is often an option, it has the disadvantage of losing product to producers who will add more value to it and, in some cases, transportation may present its own difficulties in dealing with bulk shipping of a chemical classed as a hazardous material.

The removal of benzene is, however, accompanied by a decrease in product octane quality since benzene and other single ring aromatics make a positive contribution to product octane. Certain processes have been proposed for converting the benzene in aromatics-containing refinery streams to the less toxic alkylaromatics such as toluene and ethyl benzene which themselves are desirable as high octane blend components. One process of this type was the Mobil Benzene Reduction (MBR) Process which, like the closely related MOG Process, used a fluidized zeolite catalyst in a riser reactor to alkylate benzene in reformate to from alkylaromatics such as toluene. The MBR and MOG processes are described in U.S. Pat. Nos. 4,827,069; 4,950,387; 4,992,607 and 4,746,762.

Another problem facing petroleum refineries without convenient outlets for petrochemical feedstocks is that of excess light olefins. Following the introduction of catalytic cracking processes in petroleum refining in the early 1930s, large amounts of olefins, particularly light olefins such as ethylene, propylene, butylene, became available in copious quantities from catalytic cracking plants in refineries. While these olefins are highly useful as petrochemical feedstocks, the refineries without petrochemical capability or economically attractive and convenient markets for these olefins may have to use the excess light olefins in fuel gas, at a significant economic loss or, alternatively, convert the olefins to marketable liquid products. A number of different polymerization processes for producing liquid motor fuels from cracking off-gases evolved following the advent of the catalytic cracking process but at the present, the solid phosphoric acid [SPA] polymerization process remains the most important refinery polymerization process for the production of motor gasoline. This process has however, its own drawbacks, firstly in the need to control the water content of the feed closely because although a limited water content is required for catalyst activity, the catalyst softens in the presence of excess water so that the reactor may plug with a solid, stone-like material which is difficult to remove without drilling or other arduous operations. Conversely, if the feed is too dry, coke tends to deposit on the catalyst, reducing its activity and increasing the pressure drop across the reactor. Environmental regulation has also affected the disposal of cracking olefins from these non-integrated refineries by restricting the permissible vapor pressure (usually measured as Reid Vapor Pressure, RVP) of motor gasolines especially in the summer driving season when fuel volatility problems are most noted, potentially creating a need for additional olefin utilization capacity.

Refineries without their own petrochemicals plants or ready markets for benzene or excess light olefins therefore encounter problems from two different directions and for these plants, processes which would enable the excess olefins and the benzene to be converted to marketable products would be desirable.

The fluid bed MBR Process uses a shape selective, metallosilicate catalyst, preferably ZSM-5, to convert benzene to alkylaromatics using olefins from sources such as FCC or coker fuel gas, excess LPG or light FCC naphtha. Normally, the MBR Process has relied upon light olefin as alkylating agent for benzene to produce alkylaromatics, principally in the $C_7$-$C_8$ range. Benzene is converted, and light olefin is also upgraded to gasoline concurrent with an increase in octane value. Conversion of light FCC naphtha olefins also leads to substantial reduction of gasoline olefin content and vapor pressure. The yield-octane uplift of MBR makes it one of the few gasoline reformulation processes that is actually economically beneficial in petroleum refining.

Like the MOG Process, however, the MBR Process required considerable capital expenditure, a factor which did not favor its widespread application in times of tight refining margins. The MBR process also used higher temperatures and $C_5$+ yields and octane ratings could in certain cases be deleteriously affected another factor which did not favor widespread utilization. Other refinery processes have also been proposed to deal with the problems of excess refinery olefins and gasoline; processes of this kind have often functioned by the alkylation of benzene with olefins or other alkylating agents such as methanol to form less toxic alkylaromatic precursors. Exemplary processes of this kind are described in U.S. Pat. Nos. 4,950,823; 4,975,179; 5,414,172; 5,545,788; 5,336,820; 5,491,270 and 5,865,986.

While these known processes are technically attractive they, like the MOG and MBR processes, have encountered the disadvantage of needing to a greater or lesser degree, some capital expenditure, a factor which militates strongly against them in present circumstances.

For these reasons, a refinery process capable of being installed at relatively low capital cost and having the capability to alkylate benzene (or other aromatics) with the olefins would be beneficial to meet gasoline benzene specifications, increase motor fuel volume with high-octane alkylaromatic compounds and be economically acceptable in the current plant investment climate. For some refineries, the reactive removal of $C_2/C_3$ olefins could alleviate fuel gas capacity limitations. Such process a should:

- Upgrade $C_2$ and $C_3$ olefin from fuel gas to high octane blending gasoline
- Increase flexibility in refinery operation to control benzene content in the gasoline blending pool
- Allow refineries with benzene problems to feed the $C_6$ components (low blending octane values) to the reformer, increasing both the hydrogen production from the reformer and the blend pool octane. Benzene produced in the reformer will be removed in order to comply with gasoline product specifications.
- Have the potential, by the removal of olefins from the fuel gas, to increase capacity in the fuel system facility. For some refineries this benefit could allow an increase in severity in some key refinery process, FCC, hydrocracker, coker, etc.

The necessity of keeping capital cost low obviously favors fixed bed catalytic units over the fluid bed type operations such as MOG and MBR. Fixed bed aromatics alkylation processes have achieved commercial scale use in the petrochemical field. The Cumene Process offered for license first by Mobil Oil Corporation and now by ExxonMobil Chemical Company is a low-capital cost process using a fixed bed of a zeolite alkylation/transalkylation catalyst to react refinery propylene with benzene to produce petrochemical grade cumene. Processes for cumene manufacture using various molecular sieve catalysts have been described in the patent literature: for example, U.S. Pat. No. 3,755,483 describes a process for making petrochemical cumene from refinery benzene and propylene using a fixed bed of ZSM-12 catalyst; U.S. Pat. No. 4,393,262 and U.S. also describe processes for making cumene from refinery benzene and propylene using ZSM-12 catalysts. The use of other molecular sieve catalysts for cumene manufacture has been described in other patents: U.S. Pat. No. 4,891,458 describes use of a zeolite beta catalyst; U.S. Pat. No. 5,149,894 describes the use of a catalyst containing the sieve material SSZ-25; U.S. Pat. No. 5,371,310 describes the use of a catalyst containing the sieve material MCM-49 in the transalkylation of diisopropyl benzene with benzene; U.S. Pat. No. 5,258,565 describes the use of a catalyst containing the sieve material MCM-36 to produce petrochemical grade cumene containing less than 500 ppm xylenes.

The petrochemical alkylation processes such as those referred to above, do not lend themselves directly to use in petroleum refineries without petrochemical capacity since they require pure feeds and their products are far more pure than required in fuels production. In addition, other problems may be encountered in the context of devising a process for motor gasoline production which commends itself for use in non-integrated, small-to-medium sized refineries. One such problem is the olefins from the cracker contain ethylene and propylene in addition to the higher olefins and if any process is to be economically attractive, it is necessary for it to consume both of the lightest olefins. Propylene is more reactive than ethylene and will form cumene by reaction with benzene at lower temperatures than ethylene will react to form ethylbenzene or xylenes (by transalkylation or disproportionation). Because of this, it is not possible with existing process technologies, to obtain comparable utilization of ethylene and propylene in a process using a mixed olefin feed from the FCCU. While improved ethylene utilization could in principle, be achieved by higher temperature operation, the thermodynamic equilibrium for the propylene/benzene reaction shifts away from cumene at temperatures above about 260° C. (500° F.), with consequent loss of this product.

SUMMARY OF THE INVENTION

We have now devised a process which enables light refinery olefins from the cracker (FCCU) and other sources to be utilized for the alkylation of benzene from refinery sources to produce gasoline boiling range products. The process achieves good utilization of both the ethylene and the propylene present in a mixed olefin feed from the unsaturated gas plant (USGP) while operating under conditions favorable to the utilization of both these olefins. Thus, the present process enables the refinery to comply with gasoline benzene specifications while making good use of the mixed olefins from the FCCU. The process is operated as a fixed bed process which requires only limited capital outlay and is therefore eminently suitable for implementation in small-to-medium sized refineries as well as in their larger counterparts; in fact, being a low pressure process, it may be operated in existing low pressure units with a minimal amount of modification.

According to the present invention, light olefins including ethylene and propylene, are used to alkylate a light aromatic stream such as reformate which contains benzene or other single ring aromatic compounds such as toluene or xylene, to form a gasoline boiling range [$C_5$+-200° C.] [$C_5$+-400° F.] product containing akylaromatics. The reaction is carried out in the presence of a two-catalyst system which comprises a member of the MWW family of zeolites and an intermediate pore size zeolite such as ZSM-5. The process is carried out in a fixed bed of the catalyst.

DRAWING

FIG. 1 shows a process schematic for the aromatics alkylation unit for converting mixed light refinery olefins and benzene to motor gasoline.

DETAILED DESCRIPTION OF THE INVENTION

Process Configuration

A schematic for an olefin alkylation unit is shown in simplified from in FIG. 1. A light mixed olefin feed, typically $C_2$ and $C_3$ olefins (ethylene and propylene), optionally mixed with $C_4$ olefins such as the stream coming from the unsaturated gas plant associated with an FCCU, is led into the unit through line 10 and combined with a light aromatic stream containing benzene entering through line 11 before passing through heat exchanger 13 in which it picks up heat from the reactor effluent before being brought to reaction temperature in heater 14 from which it passes to reactor 15 by way of guard bed reactor 16*a*. The guard bed may be operated on the swing cycle with two beds, 16*a*, 16*b*, one bed being used on stream for contaminant removal and the other on regeneration in the conventional manner. If desired, a three-bed guard bed system may be used with the two beds used in series for contaminant removal and the third bed on regeneration. With a three guard system used to achieve low contaminant levels by the two-stage series sorption, the beds will pass sequentially through a three-step cycle of: regeneration, second bed sorption, first bed sorption.

The mixed olefin/benzene charge plus diluent passes through the six sequential catalyst beds 17*a*, 17*b*, 17*c*, 18*a*, 18*b* and 18*c* in reactor 15 in which the mixed olefin feed is reacted with the benzene and other single ring aromatics to form the desired alkylaromatic product. Beds 17*a*, 17*b* and 17*c* contain the MWW-based zeolite catalyst and beds 18*a*, 18*b* and 18*c* contain the other intermediate pore zeolite catalyst, e.g. ZSM-5. The feed cascades directly from the beds with the MWW zeolite to the beds with the intermediate pore size zeolite. If desired or if, for example, existing equipment requirements make it attractive, the reactions over the successive zeolites may be carried out in separate reactors with direct cascade of effluent from the first stage (MWW zeolite) to the second stage (intermediate pore zeolite) in order to take advantage of the temperature requirements of the second stage reactions.

Effluent passes out of the reactor through heat exchanger 13 and then to flash drum 20 in which the light ends are separated from the product. The alkylaromatic product passes out of flash drum 20 through line 22 to the fractionator 25 to provide the final stabilized gasoline blend component in line 26 with reboil loop 28 providing column heat; light ends from the fractionator pass out through line 27 from reflux loop 29.

The catalyst used in the guard bed will normally be the same catalyst used in the alkylation reactor as a matter of operating convenience but this is not required: if desired another catalyst or sorbent to remove contaminants from the feed may used, typically a cheaper guard bed sorbent, e.g. a used catalyst from another process or a sorbent such as alumina. The objective of the guard bed is to remove the contaminants from the feed before the feed comes to the reaction catalyst and provided that this is achieved, there is wide variety of choice as to guard bed catalysts and conditions useful to this end.

Catalyst System

The catalyst system used in the present process contain two essential catalytic components. One component includes a molecular sieve of the MWW type and the other, an intermediate pore size zeolite.

MWW Zeolite

The MWW family of zeolite materials has achieved recognition as having a characteristic framework structure which presents unique and interesting catalytic properties. The MWW topology consists of two independent pore systems: a sinusoidal ten-member ring [10 MR] two dimensional channel separated from each other by a second, two dimensional pore system comprised of 12 MR super cages connected to each other through 10 MR windows. The crystal system of the MWW framework is hexagonal and the molecules diffuse along the [100] directions in the zeolite, i.e., there is no communication along the c direction between the pores. In the hexagonal plate-like crystals of the MWW type zeolites, the crystals are formed of relatively small number of units along the c direction as a result of which, much of the catalytic activity is due to active sites located on the external surface of the crystals in the form of the cup-shaped cavities. In the interior structure of certain members of the family such as MCM-22, the cup-shaped cavities combine together to form a supercage. The MCM-22 family of zeolites has attracted significant scientific attention since its initial announcement by Leonovicz et al. in Science 264, 1910-1913 [1994] and the later recognition that the family includes a number of zeolitic materials such as PSH 3, MCM-22, MCM-49, MCM-56, SSZ-25, ERB-1, ITQ-1, and others. Lobo et al. AIChE Annual Meeting 1999, Paper 292J.

The relationship between the various members of the MCM-22 family have been described in a number of publications. Three significant members of the family are MCM-22, MCM-36, MCM-49, and MCM-56. When initially synthesized from a mixture including sources of silica, alumina, sodium, and hexamethylene imine as an organic template, the initial product will be MCM-22 precursor or MCM-56, depending upon the silica: alumina ratio of the initial synthesis mixture. At silica:alumina ratios greater than 20, MCM-22 precursor comprising H-bonded vertically aligned layers is produced whereas randomly oriented, non-bonded layers of MCM-56 are produced at lower silica:alumina ratios. Both these materials may be converted to a swollen material by the use of a pillaring agent and on calcination, this leads to the laminar, pillared structure of MCM-36. The as-synthesized MCM-22 precursor can be converted directly by calcination to MCM-22 which is identical to calcined MCM-49, an intermediate product obtained by the crystallization of the randomly oriented, as-synthesized MCM-56. In MCM-49, the layers are covalently bonded with an interlaminar spacing slightly greater than that found in the calcined MCM-22/MCM 49 materials. The unsynthesized MCM-56 may be calcined itself to form calcined MCM 56 which is distinct from calcined MCM-22/MCM-49 in having a randomly oriented rather than a laminar structure. In the patent literature MCM-22 is described in U.S. Pat. No. 4,954,325 as well as in U.S. Pat. Nos. 5,250,777; 5,284,643 and 5,382,742. MCM-49 is described in U.S. Pat. No. 5,236,575; MCM-36 in U.S. Pat. No. 5,229,341 and MCM-56 in U.S. Pat. No. 5,362,697.

A preferred zeolitic material for use in the catalyst of the present process is MCM-22 although zeolite MCM-49 may be found to have certain advantages relative to MCM-22. In certain cases MCM-49 exhibits greater activity than MCM-22, possibly as a result of the greater specific surface area of the zeolite crystal but MCM-22 is satisfactory and preferred in most current instances. It has been found that the MCM-22, like the other members of the MWW family, may be either used fresh, that is, not having been previously used as a catalyst or alternatively, regenerated MCM-22 or regenerated and reconditioned MCM-22 may be used. Regenerated MCM-22 may be used after it has been used in any of the catalytic processes for which it is known to be suitable but one form of regenerated MCM-22 which has been found to be highly effective in the present condensation process is MCM-22 which is previously been used for the production of aromatics such as ethylbenzene or cumene, normally using reactions such as alkyaltion and transalkylation. The cumene production (alkylation) process is described in U.S. Pat. No. 4,992,606 (Kushnerick et al). Ethylbenzene production processes are described in U.S. Pat. Nos. 3,751,504 (Keown); 4,547,605 (Kresge); and 4,016,218 (Haag); U.S. Pat. Nos. 4,962,256; 4,992,606; 4,954,663; 5,001,295; and 5,043,501 describe alkylation of aromatic compounds with various alkylating agents over catalysts comprising MWW zeolites such as PSH-3 or MCM-22. U.S. Pat. No. 5,334,795 describes the liquid phase synthesis of ethylbenzene with MCM-22.

MCM-22 and other catalysts of this family may be regenerated after catalytic use in the cumene, ethylbenzene and other aromatics production processes by conventional air oxidation techniques similar to those used with other zeolite catalysts. Regeneration of the catalyst after use in the present process results in only a modest activity loss, with the catalyst maintaining most of its fresh activity after the first regeneration. Even after multiple regenerations, e.g. 6 to 8, a reasonable and acceptable level of activity is retained. Following the air oxidation, the catalyst may be reconditioned by aqueous reconditioning treatment using water or a mildly alkaline solution, for example, a dilute solution of ammonia or sodium carbonate. Treatment with water alone at ambient temperatures has been found to be effective: the air-regenerated catalyst is cooled and then immersed in a water bath after which it is dried and returned to service. The reconditioning treatment may be continued for the empirically determined time which results in an improvement in catalyst properties. It is theorized that the reconditioning treatment enables the silanol groups on the surface of the zeolite to be re-formed after the regeneration treatment with a consequent restoration of catalytic properties which, in favorable cases, may provide a catalyst almost comparable to a fresh catalyst.

Intermediate Pore Size Zeolite

In addition to the MWW-containing component, the catalyst system also contains a different, second component which is a catalyst containing an intermediate pore size zeolite. The intermediate (or medium) pore size zeolites are by now a well-known group of zeolites notable for their capability of catalyzing many reactions of the organic molecules used in the petroleum refining and petrochemical industry as well as for their marked catalytic activity. The first synthetic member of this family, ZSM-5 (U.S. Pat. No. 3,702,886) has achieved widespread commercial use following its introduction by Mobil Oil Corporation in a number of industrially important applications. This family of zeolites is characterized by an effective pore size of generally less than about 0.7 nm, and/or pore windows in a crystal structure formed by 10-membered rings. The designation "intermediate pore size" means that the zeolites in question generally exhibit an effective pore aperture in the range of about 0.5 to 0.65 nm when the molecular sieve is in the H-form. The effective pore size of zeolites can be measured using standard adsorption techniques and compounds of known minimum kinetic diameters. See Breck, Zeolite *Molecular Sieves,* 1974 (especially Chapter 8), and Anderson et al, *J. Catalysis* 58, 114 (1979).

The medium or intermediate pore zeolites are represented by zeolites having the structure of ZSM-5, ZSM-11, ZSM-23, ZSM-35, ZSM-48 and TMA (tetramethylammonium) offretite. Of these, ZSM-5 and ZSM-11 are preferred for functional reasons while ZSM-5 is preferred as being the one most readily available on a commercial scale from many suppliers.

As noted below, the activity of the two zeolitic components of the catalyst system used in the present process is significant. The acid activity of zeolite catalysts is conveniently defined by the alpha scale described in *J. Catalysis,* Vol. VI, pp. 278-287 (1966) and Vol. 61, 395 (1980), to which reference is made for a description of the test. In this text, the zeolite catalyst is contacted with hexane under conditions prescribed in the publication, and the amount of hexane which is cracked is measured. From this measurement is computed an "alpha" value which characterizes the catalyst for its cracking activity for hexane and is used to define the activity level for the zeolites. The intrinsic rate constants for many acid-catalyzed reactions are proportional to the alpha value for a particular crystalline silicate catalyst (see "The Active Site of Acidic Aluminosilicate Catalysts," Nature, Vol. 309, No. 5959, 589-591, (1984)). The experimental conditions of the alpha test preferably include a constant temperature of 538° C. and a variable flow rate as described in detail in the Journal of Catalysis, Vol. 61, 395 (1980).

For the purposes of the present process, the catalyst should have an alpha value greater than about 1.0; if it has an alpha value no greater than about 0.5, will be considered to have substantially no activity for cracking hexane. The alpha value of the intermediate pore size zeolite of the ZSM-5 type will normally be at least 10 or even higher, for example, from 50 to 100 or even higher but it has been found that higher alpha values may increase undesired cracking activity. In comparative tests with ZSM-5 samples with alpha values of 3, 12 and 56, it was noted that the low activity ZSM-5 (alpha=12) had much lower cracking activity than the more acid counterpart (alpha=56). A further decrease in cracking activity was observed as the alpha was lowered to 3. Thus, low alpha medium pore zeolites (alpha below 20 and preferably below 10) may offer the potential to minimize cracking although operation at lower temperatures may enable more active zeolites to be used without incurring a penalty. The alpha value of the MWW zeolite is less critical although values of at least 1 are required for perceptible activity higher values over 10 may be preferred.

Catalyst Matrix

In addition to the zeolitic component, the catalysts used in the present process will usually contain a matrix material or binder in order to give adequate strength to the catalyst as well as to provide the desired porosity characteristics in the catalyst. High activity catalysts may, however, be formulated in the binder-free form by the use of suitable extrusion techniques, for example, as described in U.S. Pat. No. 4,908,120. When used, matrix materials suitably include alumina, silica, silica alumina, titania, zirconia, and other inorganic oxide materials commonly used in the formulation of molecular sieve catalysts. For use in the present process, the level of MCM-22 or ZSM-5 type (intermediate pore size) zeolite in the finished matrixed catalyst will be typically from 20 to 70% by weight, and in most cases from 25 to 65% by weight. In manufacture of a matrixed catalyst, the active ingredient will typically be mulled with the matrix material using an aqueous suspension of the catalyst and matrix, after which the active component and the matrix are extruded into the desired shape, for example, cylinders, hollow cylinders, trilobe, quadlobe, etc. A binder material such as clay may be added during the mulling in order to facilitate extrusion, increase the strength of the final catalytic material and to confer other desirable solid state properties. The amount of clay will not normally exceed 10% by weight of the total finished catalyst. Unbound (or, alternatively, self-bound) catalysts are suitably produced by the extrusion method described in U.S. Pat. No. 4,582,815, to which reference is made for a description of the method and of the extruded products obtained by its use. The method described there enables extrudates having high constraining strength to be produced on conventional extrusion equipment and accordingly, the method is eminently suitable for producing the catalysts which are silica-rich. The catalysts are produced by mulling the zeolite with water to a solids level of 25 to 75 wt % in the presence of 0.25 to 10 wt % of basic material such as sodium hydroxide. Further details are to be found in U.S. Pat. No. 4,582,815.

The present process achieves its objective of optimizing ethylene and propylene alkylation reactions by the use of the two different catalyst components under differing temperature conditions so as to favor the different equilibria as discussed above. For this reason, the two catalyst components will be contained in separate sequential beds; each catalyst component may be contained in more than one bed if multiple quench injection along the total bed length is required. The beds may be contained in a single reactor or in separate reactors.

Olefin Feed

The light olefins used as the feed for the present process are normally obtained by the catalytic cracking of petroleum feedstocks to produce gasoline as the major product. The catalytic cracking process, usually in the form of fluid catalytic cracking (FCC) is well established and, as is well known, produces large quantities of light olefins as well as olefinic gasolines and by-products such as cycle oil which are themselves subject to further refining operations. Other processes which produce olefins may, however, be used as a source of the light olefins used in the present process, for example, thermal crackers, visbreakers and cokers. Even though these sources may produce feeds containing diolefins, the zeolite catalysts described here are relatively stable to such feeds as the desired catalytic reactions take place upon the surface of the zeolite rather than within its interior pore structure.

The olefins which are primarily useful in the present process are the lighter olefins from ethylene up to butene; although the heavier olefins may also be included in the processing, they can generally be incorporated directly into the gasoline product where they provide a valuable contribution to octane. Another factor militating against their co-processing with the lighter olefins is that upon alkylation, they will tend to form relatively high carbon number products e.g. $C_{14}$+ products which are at the upper end of the gasoline boiling range and which may cause increased combustion emissions. The present process is highly advantageous in that it operates readily not only on the propylene in the mixed olefin feed but also with ethylene and thus provides a valuable route for the conversion of this cracking by-product to the desired gasoline product. The composition of a typical FCC light gas stream (saturates and unsaturates, contaminants not shown) is given in Table 1 below and of a $C_3$-$C_4$ FCC gas stream in Table 2.

TABLE 1

| FCC Light Gas Stream | | |
|---|---|---|
| Component | Wt. Pct. | Mol. Pct. |
| Ethane | 3.3 | 5.1 |
| Ethylene | 0.7 | 1.2 |
| Propane | 14.5 | 15.3 |
| Propylene | 42.5 | 46.8 |
| Iso-butane | 12.9 | 10.3 |
| n-Butane | 3.3 | 2.6 |
| Butenes | 22.1 | 18.32 |
| Pentanes | 0.7 | 0.4 |

TABLE 2

| $C_3$-$C_4$ FCC Gas Stream | |
|---|---|
| Component | Wt. Pct. |
| 1-Propene | 18.7 |
| Propane | 18.1 |
| Isobutane | 19.7 |
| 2-Me-1-propene | 2.1 |
| 1-Butene | 8.1 |
| n-Butane | 15.1 |
| Trans-2-Butene | 8.7 |
| Cis-2-butene | 6.5 |
| Isopentane | 1.5 |

TABLE 2-continued

| $C_3$-$C_4$ FCC Gas Stream | |
|---|---|
| Component | Wt. Pct. |
| C3 Olefins | 18.7 |
| C4 Olefins | 25.6 |
| Total Olefins | 44.3 |

At the same time that the olefins in the FCC off-gas participate in the desired alkylation reactions with the benzene and other aromatics present, a limited degree of olefin oligomerization (polymerization) may take place. Although this will not result in alkylation of the aromatics, it is by no means undesirable since conversion of the $C_3$ and $C_4$ olefin fractions in this way provides a direct route to the branched chain $C_6$, $C_7$ and $C_8$ products which are so highly desirable in gasoline from the view point of boiling point and octane.

While the catalysts used in the present process are robust they do have sensitivity to certain contaminants (the conventional zeolite deactivators), especially organic compounds with basic nitrogen as well as sulfur-containing organics. It is therefore preferred to remove these materials prior to entering the unit if extended catalyst life is to be expected. Scrubbing with contaminant removal washes such as caustic, MEA or other amines or aqueous wash liquids will normally reduce the sulfur level to an acceptable level of about 10-20 ppmw and the nitrogen to trace levels at which it can be readily tolerated. One attractive feature about the present process is that it is not unduly sensitive to water, making it less necessary to control water entering the reactor than it is in SPA units. Unlike SPA, the zeolite catalyst does not require the presence of water in order to maintain activity and therefore the feed may be dried before entering the unit. In conventional SPA units, the water content typically needs to be held between 300 to 500 ppmw for adequate activity while, at the same time, retaining catalyst integrity. The present zeolite catalysts, however, may readily tolerate up to about 1,000 ppmw water although levels above about 800 ppmw may reduce activity, depending on temperature.

Aromatic Feed

In addition to the light olefin feed, an aromatic stream containing benzene is fed into the process, as described above. This stream may contain other single ring aromatic compounds including alkylaromatics such as toluene, ethylbenzene, propylbenzene (cumene) and the xylenes. In refineries with associated petrochemical capability, these alkylaromatics will normally be removed for higher value use as chemicals or, alternatively, may be sold separately for such uses. Since they are already considered less toxic than benzene, there is no environmental requirement for their inclusion in the aromatic feed stream but, equally, there is no prejudice against their presence unless conditions lead to the generation of higher alkylaromatics which fall outside the gasoline range or which are undesirable in gasoline, for example, durene. The amount of benzene in this stream is governed mainly by its source and processing history but in most cases will typically contain at least about 5 vol. % benzene, although a minimum of 12 vol. % is more typical, more specifically about 20 vol. % to 60 vol. % benzene. Normally, the main source of this stream will be a stream from the reformer which is a ready source of light aromatics. Reformate streams may be full range reformates, light cut reformates, heavy reformates or heart cut reformates. These fractions typically contain smaller amounts of lighter hydrocarbons, typically less than about 10% $C_5$ and lower hydrocarbons and small amounts of heavier hydrocarbons, typically less than about 15% $C_7$+ hydrocarbons. These reformate feeds usually contain very low amounts of sulfur as, usually, they have been subjected to desulfurization prior to reforming so that the resulting gasoline product formed in the present process contains an acceptably low level of sulfur for compliance with current sulfur specifications.

Reformate streams will typically come from a fixed bed, swing bed or moving bed reformer. The most useful reformate fraction is a heart-cut reformate. This is preferably reformate having a narrow boiling range, i.e. a $C_6$ or $C_6/C_7$ fraction. This fraction is a complex mixture of hydrocarbons recovered as the overhead of a dehexanizer column downstream from a depentanizer column. The composition will vary over a range depending upon a number of factors including the severity of operation in the reformer and the composition of the reformer feed. These streams will usually have the $C_5$, $C_4$ and lower hydrocarbons removed in the depentanizer and debutanizer. Therefore, usually, the heart-cut reformate will contain at least 70 wt. % $C_6$ hydrocarbons, and preferably at least 90 wt. % $C_6$ hydrocarbons.

Other sources of aromatic, benzene-rich feeds include a light FCC naphtha, coker naphtha or pyrolysis gasoline but such other sources of aromatics will be less important or significant in normal refinery operation.

By boiling range, these benzene-rich fractions can normally be characterized by an end boiling point of about 120° C. (250° F)., and preferably no higher than about 110° C. (230° F.). Preferably, the boiling range falls between 40° and 100° C. (100° F. and 212° F.), and more preferably between the range of 65° to 95° C. (150° F. to 200° F.) and even more preferably within the range of 70° to 95° C. (160° F. to 200° F.).

The compositions of two typical heart cut reformate streams are given in Tables 3 and 4 below. The reformate shown in Table 4 is a relatively more paraffinic cut but one which nevertheless contains more benzene than the cut of Table 3, making it a very suitable substrate for the present alkylation process.

TABLE 3

| C6-C7 Heart Cut Reformate | |
|---|---|
| RON | 82.6 |
| MON | 77.3 |
| Composition, wt. pct. | |
| i-$C_5$ | 0.9 |
| n-$C_5$ | 1.3 |
| $C_5$ napthenes | 1.5 |
| i-$C_6$ | 22.6 |
| n-$C_6$ | 11.2 |
| $C_6$ naphthenes | 1.1 |
| Benzene | 32.0 |
| i-$C_7$ | 8.4 |
| n-$C_7$ | 2.1 |
| $C_7$ naphthenes | 0.4 |
| Toluene | 17.7 |
| i-$C_8$ | 0.4 |
| n-$C_8$ | 0.0 |
| $C_8$ aromatics | 0.4 |

TABLE 4

| Paraffinic C6-C7 Heart Cut Reformate | |
|---|---|
| RON | 78.5 |
| MON | 74.0 |
| Composition, wt. pct. | |
| i-$C_5$ | 1.0 |
| n-$C_5$ | 1.6 |
| $C_5$ napthenes | 1.8 |
| i-$C_6$ | 28.6 |
| n-$C_6$ | 14.4 |
| $C_6$ naphthenes | 1.4 |
| Benzene | 39.3 |
| i-$C_7$ | 8.5 |
| n-$C_7$ | 0.9 |
| $C_7$ naphthenes | 0.3 |
| Toluene | 2.3 |

Reformate streams will come from a fixed bed, swing bed or moving bed reformer. The most useful reformate fraction is a heart-cut reformate. This is preferably reformate having a narrow boiling range, i.e. a $C_6$ or $C_6/C_7$ fraction. This fraction is a complex mixture of hydrocarbons recovered as the overhead of a dehexanizer column downstream from a depentanizer column. The composition will vary over a range depending upon a number of factors including the severity of operation in the reformer and the composition of the reformer feed. These streams will usually have the $C_5$, $C_4$ and lower hydrocarbons removed in the depentanizer and debutanizer. Therefore, usually, the heart-cut reformate may contain at least 70 wt. % $C_6$ hydrocarbons (aromatic and non-aromatic), and preferably at least 90 wt. % $C_6$ hydrocarbons.

Other sources of aromatic, benzene-rich feeds include a light FCC naphtha, coker naphtha or pyrolysis gasoline but such other sources of aromatics will be less important or significant in normal refinery operation.

Product Formation

During the alkylation process, a number of mechanistically different reactions take place. The light olefins in the feed react with the single ring aromatics in the aromatic feed to form high-octane number single ring alkylaromatics. As noted above, the ethylene-aromatic alkylation reactions are favored over the intermediate pore size zeolite catalyst while the propylene-aromatic reactions being favored over the MWW zeolite catalyst. As both reactions are exothermic with the ethylene-aromatic alkylation achieving equilibrium at higher temperatures, the preferred reaction order will be to have the bed of MWW zeolite catalyst first so that the exotherm from the propylene-aromatic reaction (with some ethylene-aromatic reaction) adds to stream enthalpy to increase the reaction for the ethylene-aromatic reaction over the intermediate pore size zeolite catalyst. At the same time, the increase in temperature of the stream should be controlled by the addition of quench, if necessary, to avoid second stage temperatures which disfavor the $C_3$-alkylaromatic equilibrium.

At the same time, as the alkylation reactions are proceeding, the olefins may undergo some condensation (oligomerization, polymerization) to form branched chain paraffins of high octane rating by reactions. Normally, the oligomerization should be controlled by suitable choice of reaction conditons (olefin:aromatic feed ratio, temperature, pressure, space velocity, zeolite activity) so as to control the amount of products having a carbon number above 10, preferably not above 8, since the most valuable gasoline hydrocarbons are at $C_7$-$C_8$ from the viewpoint of volatility including RVP and engine operation at varying conditions. Usually, the degree of oligomerization will be from the dimerization in which butenes are converted to $C_8$ products, some trimerization in which ethylene and propylene will be converted to products from $C_6$ to $C_9$ and some higher degrees of oligomerization. Interpolymerization may, of course, take place between the different olefin species present to result in an oligomeric product with a continuum of carbon numbers in the gasoline boiling range. To the extent that a small amount of oligomerized unsaturates are formed, they may participate in the alkylation reactions but the proportion of these reactions taking place is normally limited.

After separation of light ends from the final reactor effluent stream with the recycle options referred to above for quench and dilution, the gasoline boiling range product is taken from the stripper or fractionator. Because of its content of high octane number alkylaromatics, it will normally have an octane number of at least 92 and often higher, e.g. 95 or even 98. This product forms a valuable blend component for the refinery blend pool for premium grade gasoline.

Process Parameters

The present process is notable for its capability of being capable of operation at low to moderate pressures. In general, pressures up to about 7,500 kPag (approximately 1,100 psig) will be adequate. As a matter of operating convenience and economy, however, low to moderate pressures up to about 3,500 kPag (about 500 psig) may be preferred, permitting the use of low pressure equipment. Pressures within the range of about 750 to 2,500 kPag (approximately 110 to 360 psig) will normally be adequate. It has been found that increasing the pressure from about 1725 kPag (250 psig) to about 2410 kPag (350 psig) may decrease olefin conversion and for this reason pressures of about 1600 to 1900 kpag (about 230 to 275 psig) may be optimal although a number of factors may affect the exact choice of pressure.

Both steps of the process are carried out in the vapor phase in order to utilize the equilibria in the manner described. In general, the overall temperature will be from about 90° to 400° C. (approximately 190° to 750° F.). Assuming that the preferred configuration of MWW-stage first is employed, the feed (reactor inlet) is preferably held in the range of 90° to 250° C. (approximately 190° to 480° F.) with the first stage exotherm controlled to achieve a second stage reactor (ZSM-5 type catalyst) inlet temperature within the range of 200° to 325° C. (approximately 400° to 620° F.). The optimal temperature range for the catalyst bed (medium pore catalyst) is believed to be in the range of 300°-400° C. (about 570°-750° F.), preferably 345°-375° C. (about 650°-710° F.) although the acidity of the zeolite may affect the finally selected temperature if excessive cracking is to be avoided. The temperature may be controlled by the normal expedients of controlling feed rate, quench injection rate and dilution ratio; temperature differential between the two steps of the reaction may be controlled by adjustment of quench at the various quench injection points. Normally the effluent from the first step can be cascaded directly to the second step in order to take advantage of the first stage exotherm for meeting the second stage temperature.

Space velocity on the olefin will normally be from 0.5 to 2.0 WHSV ($hr^{-1}$) and in most cases from 0.75 to 1.0 WHSV ($hr^{-1}$) with a value of 1.0 WHSV ($hr^{-1}$) being a convenient operating value. No added hydrogen is required.

The ratio between the olefin and aromatic feed components is normally chosen to achieve the desired process objective, be it benzene reduction, olefin conversion or a number of objectives. If benzene reduction is the primary objective, a relatively low aromatics:olefin ratio is desirable in order to favor aromatics alkylation using the excess olefins. In this case, it is preferred that the ratio of aromatics to olefins should not exceed 1:1 by weight. Using ratios below 1 in this way will, besides decreasing benzene in the product, limit conversion and increase the extent of di-alkylation; conversely, using higher ratios above 1:1, for example, 1.5:1 (aromatic: olefin, by weight) will increase conversion and the benzene in the product but reduce di-alkylation. Optimal conditions may therefore be determined empirically depending on feed composition, available feed rates, product objectives and unit type.

The invention claimed is:

1. A method for producing a gasoline boiling range product from a mixed light olefin feed stream including ethylene and propylene and an aromatic feed stream including single ring aromatic compounds, which process comprises:

reacting single ring aromatic compounds including benzene in the aromatic feed stream with propylene in the mixed olefin feed stream in a first step in the vapor phase in the presence of a catalyst system comprising a catalyst component comprising a zeolite of the MWW family in a fixed catalyst bed at a bed temperature in the range of 90° to 250° C. and a pressure not more than 7,000 kPag passing the effluent from the first step to a second step in which single ring aromatic compounds including benzene in the aromatic feed stream are reacted with ethylene in the mixed olefin feed stream in the vapor phase in the presence of a catalyst system comprising a catalyst component comprising a ZSM-5 intermediate pore size zeolite in a fixed catalyst bed at a bed temperature higher than that of the first step and in the range of 200° to 400° C. and a pressure not more than 7,000 kPag, to form a gasoline boiling range product containing akylaromatics.

2. A method according to claim 1 in which the zeolite of the MMW family comprises a zeolite of the MCM-22 family.

3. A method according to claim 2 in which the intermediate pore size zeolite comprises ZSM-5 having an alpha value below 50.

4. A method according to claim 3 in which the intermediate pore size zeolite comprises ZSM-5 having an alpha value below 20.

5. A method according to claim 2 in which the bed temperature of ZSM-5 zeolite catalyst is in the range of 345° to 375 ° C.

6. A method according to claim 2 in which the pressure in the bed of the ZSM-5 zeolite catalyst is from 1600 to 1900 kPag.

7. A method according to claim 2 in which the effluent from the first step is directly cascaded to the second step.

* * * * *